US005147245A

United States Patent [19]

Schoeps

[11] Patent Number: 5,147,245

[45] Date of Patent: Sep. 15, 1992

[54] HYDRAULIC TORQUE IMPULSE GENERATOR

[75] Inventor: Knut C. Schoeps, Tyresö, Sweden

[73] Assignee: Atlas Copco Tools AB, Stockholm, Sweden

[21] Appl. No.: 722,693

[22] Filed: Jun. 28, 1991

[30] Foreign Application Priority Data

Jul. 3, 1990 [SE] Sweden ..... 9002328

[51] Int. Cl.[5] ..... B25B 21/02; B25D 15/00

[52] U.S. Cl. ..... 464/25

[58] Field of Search ..... 464/25, 24; 173/93, 173/94, 93.5, 90; 81/57.44

[56] References Cited

U.S. PATENT DOCUMENTS 4,767,379 8/1988 Schoeps ..... 464/25
4,785,693 11/1988 Minamiyama ..... 464/25 X
4,884,995 12/1989 Schoeps ..... 464/25

*Primary Examiner*—Daniel P. Stodola
*Assistant Examiner*—William G. Battista, Jr.
*Attorney, Agent, or Firm*—Frishauf, Holtz, Goodman & Woodward

[57] ABSTRACT

A hydraulic torque impulse generator comprises a hollow drive member (21) connected to a rotation motor (16) and comprising a fluid chamber (24) with axially extending seal lands (35, 36) and seal ridges (40, 41) on its peripheral wall for sealing cooperation with radially movable seal elements (33, 34) and axially extending seal ridges (38, 39) on an output spindle (18, 22) to divide the fluid chamber (24) into high pressure compartments (H.P.) and low pressure compartments (L.P.) during short intervals of the relative rotating between the drive member (21) and the output spindle (18, 22). The fluid chamber (24) is defined also by two opposite end walls (25, 28), one (25) of which comprises an annular, nonresilient contact element (37) which is axially displaceable between an active seal position in which it is urged against the seal elements (33, 34) and shoulders (43, 30) on the spindle portion (22) and the fluid chamber wall (20), respectively, and a rest position. In the latter position, the axial clearances between the spindle shoulders (42, 43) and vanes (33, 34) on one hand and the end walls (28, 25) of the fluid chamber (24) on the other is allowed to increase such that a substantially reduced viscous friction between the parts is obtained.

5 Claims, 2 Drawing Sheets

HYDRAULIC TORQUE IMPULSE GENERATOR

BACKGROUND OF THE INVENTION

This invention relates to a hydraulic torque impulse generator of the type having a drive member connected to a rotation motor and including a cylindrical fluid chamber defined by a circumferential wall and two end walls, an output spindle rotatably supported in a coaxial relationship with the drive member and having a rear portion extending into the fluid chamber, which spindle portion has at least one radial slot each supporting a radially movable seal element for sealing cooperation with seal lands on the circumferential fluid chamber wall, and first seal ridges on the rear spindle portion for sealing cooperation with second seal ridges on the circumferential fluid chamber wall, for dividing the fluid chamber into at least one high pressure compartment and at least one low pressure compartment during short intervals of the relative rotation between the drive member and the output spindle.

In hydraulic torque impulse generators of the above type there is a problem both to have a good sealing action between the rear spindle portion, inclusive of the seal elements, and the fluid chamber end walls during impulse generation and to have a low friction relative rotation between the drive member and the rear spindle portion between each impulse generating phase. If very small clearances are used, between the ends of the rear spindle portion and the end walls of the fluid chamber, a good tightness is obtained, which would result in high peak pressures. Unfortunately, the small clearances also means a very thin fluid film between the moving parts, which causes a high viscous friction and a slow acceleration of the drive member relative to the output spindle before each impulse generating phase. The result is not an increased power output of the impulse generator, because the energy in each torque impulse depends not only on the tightness of the fluid chamber compartments but also on the relative speed of the drive member and the output spindle. A slow acceleration of the drive member also means a low impulse rate.

The object of the invention is to accomplish an improved power output of a torque impulse generator of the above type by combining a good tightness of the fluid chamber compartments during the impulse generating phase and a low friction acceleration phase.

BRIEF DESCRIPTION OF THE DRAWINGS

A preferred embodiment of the invention is described below with reference to the accompanying drawings, in which.

DETAILED DESCRIPTION

Figures 1, 2:
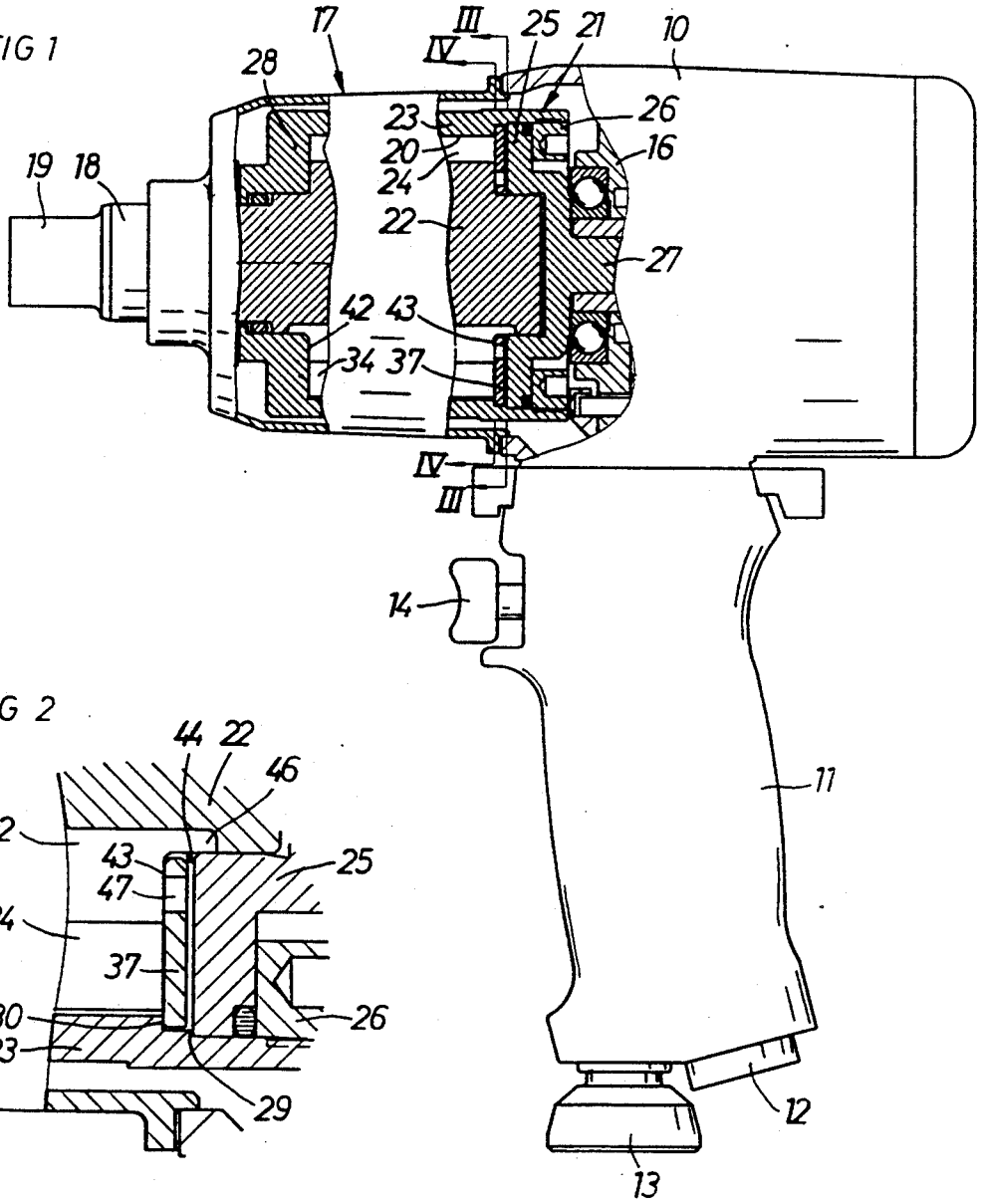
FIG. 1 shows, partly in section, a side view of a power wrench comprising a torque impulse generator according to the invention.
FIG. 2 shows, on a larger scale, a fractional section of the device in FIG. 1.
Figure 3:
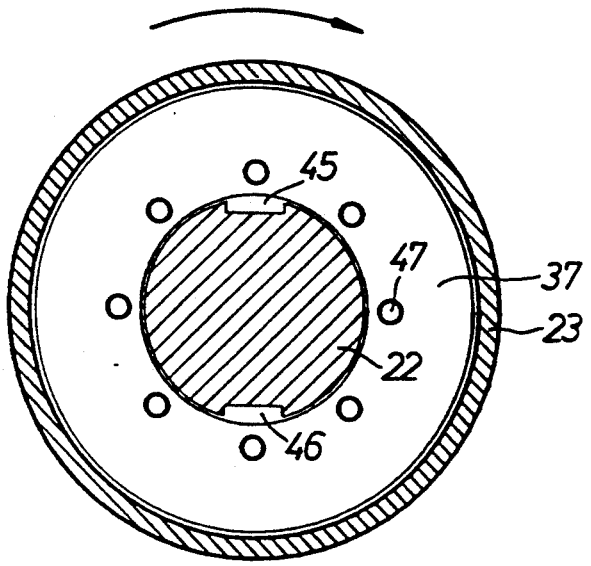
FIG. 3 shows a cross section along line III—III in FIG. 1.
Figure 4:
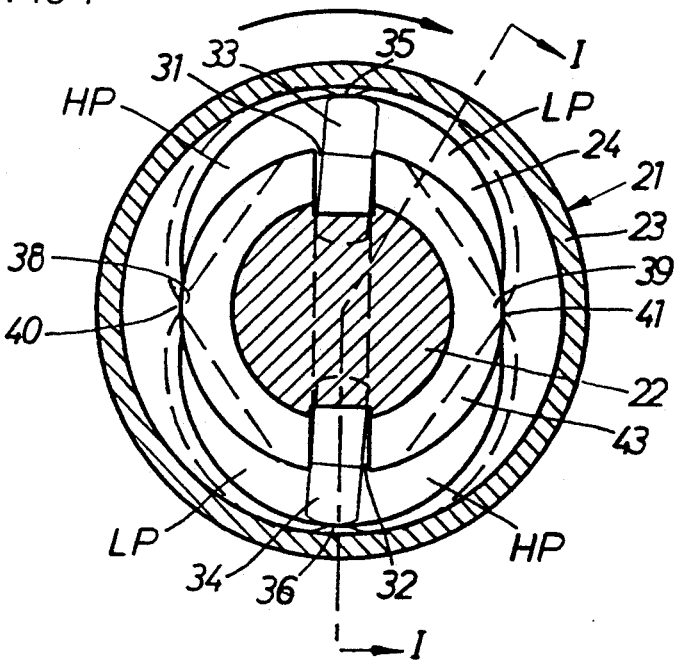
FIG. 4 shows a cross section along line IV—IV in FIG. 1. The sectional part of FIG. 1 illustrates a section taken along line I-I in FIG. 4.

The power wrench shown in FIG. 1 is pneumatically powered and comprises a housing 10, a handle 11, a pressure air conduit connection 12 and an exhaust silencer 13 located at the lower end of the handle 11, and a throttle valve operated by a trigger 14.

In the rear part of the housing 10 there is located a pneumatic vane motor 16 which via a hydraulic torque impulse generator 17 is drivingly connected to an output spindle 18. The latter is formed with a square end 19 for connection of a nut socket.

The impulse generator which generally is of a type prevously described in for instance E.P. Application No. 0 290 411, includes a drive member 21 drivingly coupled to the motor 16 and a rear portion 22 of the output spindle 18.

The drive member 21 comprises a tube shaped portion 23 enclosing a cylindrical fluid chamber 24 with a circumferential wall 20 and end walls 25, 28. The rear end wall 25 is secured to the tube shaped portion 23 by means of a ring nut 26. The rear end wall 25 is formed with a rearwardly extending stub axle 27 which is drivingly coupled via a spline connection to the motor 16. The forward end wall 28 of the fluid chamber 24 is integral with the tube shaped portion 23.

As is apparent from FIG. 2, the rear end wall 25 is clamped by the nut 26 against a first shoulder 29 in the drive member portion 23. A second shoulder 30 is formed on the portion 23 to cooperate sealingly with an annular contact element 37 located inside the end wall 25. The contact element 37 is axially displaceable between the shoulder 30 and the end wall 25.

The rear portion 22 of the output spindle 18 is formed with two diametrically opposite radial slots 31, 32 in which two sliding vanes 33, 34 are supported. The vanes 33, 34 are arranged to sealingly cooperate with two axially extending seal lands 35, 36 on the wall 20 of the fluid chamber 24. 90° circumferentially spaced from the vane slots 31, 32, the spindle portion 22 is formed with a first set of two diametrically opposite seal ridges 38, 39 for sealing cooperation with a second set of two corresponding seal ridges 40, 41 on the fluid chamber wall 20. The latters are 90° circumferentially spaced from the seal lands 35, 36.

By simultaneous sealing cooperation between the vanes 33, 34 and the lands 35, 36 as well as between the first set of seal ridges 38, 39 and the second set of seal ridges 40, 41, the fluid chamber 24 is divided into two high pressure compartments H.P. and two low pressure compartments L.P. This occurs during short intervals of the relative rotation between the drive member 21 and the output spindle 18.

Preferably, valve means are provided to avoid, via bypass connections, that torque impulses are generated more than once every relative revolution between the drive member 21 and the output spindle 18. Such valve means could be of any previously known type and are not described in detail.

At its ends, the spindle portion 22 has annular shoulders 42 and 43 which are located substantially flush with the ends of the vanes 33, 34. The contact element 37 is arranged to cooperate sealingly with the shoulder 43, the rear ends of the vanes 33, 34 as well as with the shoulder 30 on the fluid chamber wall 20. For accomplishing a contact pressure between the element 37 and the shoulders 43 and 30 and the vanes 33, 34, there is formed a pressure chamber 44 between the element 37 and the end wall 25. This pressure chamber 44 communicates with the high pressure compartments H.P. of the fluid chamber 24 via axial grooves 45, 46 which extend rearwardly from the Vane slots 31, 32.

The contact element 37 comprises a flat, annular washer provided with a number of through openings 47 which are intended to facilitate fluid communication between the area between the contact element 37 itself and the shoulder 43 and the pressure chamber 44.

Once every relative revolution between the drive member 21 and the output spindle 18, the sealing cooperation between the vanes 33, 34 and the lands 35, 36 and between the seal ridges 38, 39 and 40, 41, respectively, accomplishes a pressure build-up in the high pressure compartments H.P. to, thereby, generate a torque impulse. At the same time, the high pressure propagates to the pressure chamber 44 via the vane slots 31, 32 and the grooves 45, 46 to force the contact element 37 against the shoulders 43 and 30 and the ends of the vanes 33, 34. This means that the best possible sealing contact is obtained at the end surfaces of the impulse generator. By the force exerted by the contact element 37, the spindle 18 and the vanes 33, 34 are also urged forwards to obtain a good sealing contact between the shoulder 42 and the forward end wall 28 of the fluid chamber 24.

In prior art impulse generators, the distance between the spindle shoulders 30 and 42 is somewhat larger than the length of the vanes 33, 34 to ensure that the vanes do not get jammed or cause frictional resistance in their contact with the end walls. This inevitably causes a poor sealing of the high pressure compartments. Since these problems are effectively avoided by the contact element arrangement according to the invention, the length of the vanes can be exactly equal to the distance between the shoulders 30 and 42. This means that the tightness of the high pressure compartments H.P. is considerably improved during the impulse generating phase as the contact element 37 gets a good sealing contact both with the ends of the vanes 33, 34 and the shoulders 43 and 30.

Moreover, the axially displaceable contact element 37 also ensures that there is a very low viscous friction between the ends of the vanes 33, 34 and the spindle portion 22 on one hand and the fluid chamber end walls on the other during the drive member 21 acceleration phase. As soon as the sealing contact between the vanes 33, 34 and the lands 35, 36 and between the first and second sets of seal ridges 38, 39 and 40, 41, respectively, is discontinued and the pressure peaks in the high pressure compartments H.P. have ceased, there is no longer any pressure in chamber 44 and the contact element 37 retracts automatically from its active seal position to a rear rest position. Now, the clearance between the contact element 37 and the non-rotating parts, the vanes 33, 34 and the spindle portion 22, increases to a width where practically no viscous friction exists. This facilitates acceleration of the drive member 21 and results in an increased impulse rate delivered by the tool.

Although in the above described example the contact element arrangement is located at the rear end wall of the fluid chamber, it is to be understood that the invention is not limited to that specific design. The contact element arrangement according to the invention may as well be associated with the forward end wall of the fluid chamber.

I claim:

1. Hydraulic torque impulse generator, comprising a drive member (21) connected to a rotation motor (16) and including a cylindrical fluid chamber (24) defined by a circumferential wall (20) and two end walls (25, 28), an output spindle (18) rotatably supported in a coaxial relationship with said drive member (21) and having a rear portion (22) extending into said fluid chamber (24), said rear spindle portion (22) having at least one radial slot (31, 32) each supporting a radially movable seal element (33, 34) for sealing cooperation with seal lands (35, 36) on the circumferential fluid chamber wall (20), and first seal ridges (38, 39) on said rear spindle portion (22) for sealing cooperation with second seal ridges (40, 41) on said circumferential fluid chamber wall (20), thereby dividing said fluid chamber (24) into at least one high pressure compartment (H.P.) and at least one low pressure compartment (L.P.) during short intervals of the relative rotation between said drive member (21) and said output spindle (18), wherein an annular, non-resilient contact element (37) is associated with one of said fluid chamber end walls (25), said contact element (37) is freely axially displaceable between a rest position and an active position in which it cooperates sealingly with said seal elements (33, 34) and said rear spindle portion (22) for sealing off said at least one high pressure compartment (H.P.) from said at least one low pressure compartment (L.P.), a pressure chamber (44) formed between said contact element (37) and the respective end wall, and a passage means (45, 46) connecting said pressure chamber (44) with said at least one high pressure compartment (H.P.) during said short rotation intervals to thereby impart a bias pressure on said contact element (37) toward said active position.

2. Impulse generator according to claim 1, wherein said contact element (37) is flat in shape.

3. Impulse generator according to claim 1 or 2, wherein said rear spindle portion (22) comprises an annular shoulder (43) which is located flush with one of the ends of said seal element or elements (33, 34), said contact element (37) being in sealing contact with said annular shoulder (43) as well as said seal element end or ends in its active position.

4. Impulse generator according to claim 3, wherein said passage means (45, 46) comprises one or more axial grooves in said rear spindle portion (22) connecting said pressure chamber (44) with said at least one high pressure compartment (H.P.).

5. Impulse generator according to claim 4, wherein said one or more axial grooves (45, 46) are extensions of said at least one radial slot (31, 32).

* * * * *